US005826787A

United States Patent [19]

Turner

[11] Patent Number: 5,826,787

[45] Date of Patent: Oct. 27, 1998

[54] TWO-WAY MAILER ENVELOPE

[75] Inventor: Simon Christopher Turner, New Westminster, Canada

[73] Assignee: Fraser Envelopes Ltd., British Columbia, Canada

[21] Appl. No.: 651,206

[22] Filed: May 17, 1996

Related U.S. Application Data

[63] Continuation of Ser. No. 334,734, Nov. 4, 1994, abandoned.

[51] Int. Cl.[6] ..... B65D 27/06; B65D 27/04

[52] U.S. Cl. ..... 229/303; 229/302

[58] Field of Search ..... 229/300, 301, 229/303, 92.3, 302

[56] References Cited

U.S. PATENT DOCUMENTS

| | | | |
|---|---|---|---|
| 2,340,700 | 2/1944 | Sawdon | 229/306 |
| 3,380,648 | 4/1968 | de Lyra | 229/80 X |
| 4,180,168 | 12/1979 | Hiersteiner . | |
| 4,190,161 | 2/1980 | Gendron | 229/313 |
| 4,245,775 | 1/1981 | Conn | 229/303 X |
| 4,308,987 | 1/1982 | Solomon . | |
| 4,332,346 | 6/1982 | Kronman | 229/303 X |
| 4,354,631 | 10/1982 | Stevenson . | |
| 4,382,539 | 5/1983 | Kronman . | |
| 4,436,202 | 3/1984 | Berkley . | |
| 4,565,317 | 1/1986 | Kranz . | |
| 4,602,736 | 7/1986 | Barr . | |
| 4,688,715 | 8/1987 | Barr . | |
| 4,690,322 | 9/1987 | Burns . | |
| 4,896,823 | 1/1990 | Taylor . | |
| 4,899,926 | 2/1990 | Spaulding . | |
| 4,927,072 | 5/1990 | Jenkins et al. . | |
| 4,934,536 | 6/1990 | Mills . | |
| 4,944,449 | 7/1990 | Schmidt . | |
| 4,945,218 | 7/1990 | Talbott . | |
| 4,960,237 | 10/1990 | Bendel . | |
| 4,981,251 | 1/1991 | Jenkins et al. . | |
| 5,024,374 | 6/1991 | Ashby . | |
| 5,025,980 | 6/1991 | Blackman . | |
| 5,039,000 | 8/1991 | Ashby . | |
| 5,040,720 | 8/1991 | Pennock . | |
| 5,052,613 | 10/1991 | Lin | 229/303 |
| 5,071,399 | 12/1991 | Ashby . | |
| 5,104,036 | 4/1992 | Rutkowski et al. . | |
| 5,110,043 | 5/1992 | Ashby . | |
| 5,118,030 | 6/1992 | McNamara et al. . | |
| 5,118,031 | 6/1992 | Tighe . | |
| 5,125,562 | 6/1992 | Bendel . | |
| 5,232,150 | 8/1993 | Solomons | 229/303 X |

FOREIGN PATENT DOCUMENTS

| | | | |
|---|---|---|---|
| 642123 | 9/1993 | Australia | 229/301 |
| 395024 | 3/1941 | Canada . | |
| 575486 | 5/1959 | Canada . | |
| 634457 | 1/1962 | Canada . | |
| 718300 | 9/1965 | Canada . | |
| 2098971 | 12/1993 | Canada . | |
| 2123247 | 11/1994 | Canada . | |
| 343731 | 4/1937 | Italy | 229/313 |
| 680124 | 6/1992 | Switzerland | 229/313 |
| 93/19991 | 10/1993 | WIPO | 229/303 |

*Primary Examiner*—Jes F. Pascua
*Attorney, Agent, or Firm*—Oyen Wiggs Green & Mutala

[57] ABSTRACT

An envelope having front and rear faces which are joined to form a pocket defined by an opening between respective upper edges of the front and rear faces. A flap is joined to the upper edge of the front face and may be folded to overlap a portion of the rear face. An adhesive region is provided on an inner face of the flap, with a line of weakness extending across the adhesive region. When the envelope is first used, only that portion of the adhesive region above the line of weakness is used to fix the flap to the rear face. The addressee opens the envelope by tearing the flap along the line of weakness. The opened envelope can then be reused, with that portion of the adhesive region beneath the line of weakness being used to again fix the flap to the rear face.

2 Claims, 10 Drawing Sheets

10
22
16
18
14

20
18
16A
22
16B
14
10

A
B
16
10
18
20
22
12
14

10
16B
16A
22
18
14

TWO-WAY MAILER ENVELOPE

This application is a continuation of now abandoned application, Ser. No. 08/334,734, filed Nov. 4, 1994.

FIELD OF THE INVENTION

This application pertains to a "two-way" mailer envelope which may be reused by the addressee to mail material to another party.

BACKGROUND OF THE INVENTION

"Two-way" mailer envelopes exist in various forms. Often, the addressee must carefully follow a prescribed sequence of steps in order to open the envelope without damaging it to such an extent that it cannot be reused to mail material to another party. Typically, two-way mailer envelopes must be reassembled by the addressee performing a sequence of steps to reconfigure the envelope for reuse after it has been opened. These factors tend to discourage reuse of two-way mailer envelopes. Such reuse is desirable not only from an environmental conservation standpoint, but also because, by utilizing a two-way mailer envelope which the addressee can easily reuse, the party contacting the addressee may ensure more rapid receipt of return correspondence. This can be particularly important if the return correspondence is in the form of payment of a bill enclosed in the two-way mailer envelope originally delivered to the addressee.

The present invention provides an easy-to-use two-way mailer envelope which addresses the foregoing concerns.

SUMMARY OF THE INVENTION

In accordance with the preferred embodiment, the invention provides an envelope having front and rear faces which are joined to form a pocket defined by an opening between respective upper edges of the front and rear faces. A flap is joined to the upper edge of the front face and may be folded to overlap a portion of the rear face. A line of weakness extends across the flap. Adhesive may be pre-applied to the envelope or may be applied by automatic mailing machinery. The adhesive is applied to initially seal the envelope by fixing the flap to the rear face and to provide for later re-sealing of the envelope for re-mailing thereof. The addressee opens the envelope by tearing the flap along the line of weakness. The opened envelope can then be reused, with a portion of the adhesive being used to again fix the flap to the rear face.

In some embodiments, a non-adhesive gap may overlie the line of weakness and separate the adhesive region into first and second adhesive zones, although this is not essential. This assists in preventing migration of an adhesive-wetting agent, such as water, between the two adhesive zones.

Advantageously, a means is provided to assist in tearing the flap along the line of weakness. For example, at least one notch may be provided in the flap at one end of the line of weakness; or, notches may be provided in the flap at both ends of the line of weakness. Alternatively, a tear strip may be embedded in the flap to extend along the line of weakness. As a further alternative, a second line of weakness extending across the adhesive region may be provided.

In some embodiments a removable label may be adhered to the envelope's rear face. The label is of a size and is positioned to receive return address bar code indicia applied by mail handling apparatus.

In some embodiments an address aperture may be provided in the envelop's front face, with a transparent, water-soluble membrane such as poly-vinyl-alcohol fixed to an inner portion of the front face and overlying the aperture.

BRIEF DESCRIPTION OF THE DRAWINGS

FIGS. 1A through 1D are all rear elevation views of the envelope.

DETAILED DESCRIPTION OF THE PREFERRED EMBODIMENT

Figures 1A, 1B, 1C, 1D:
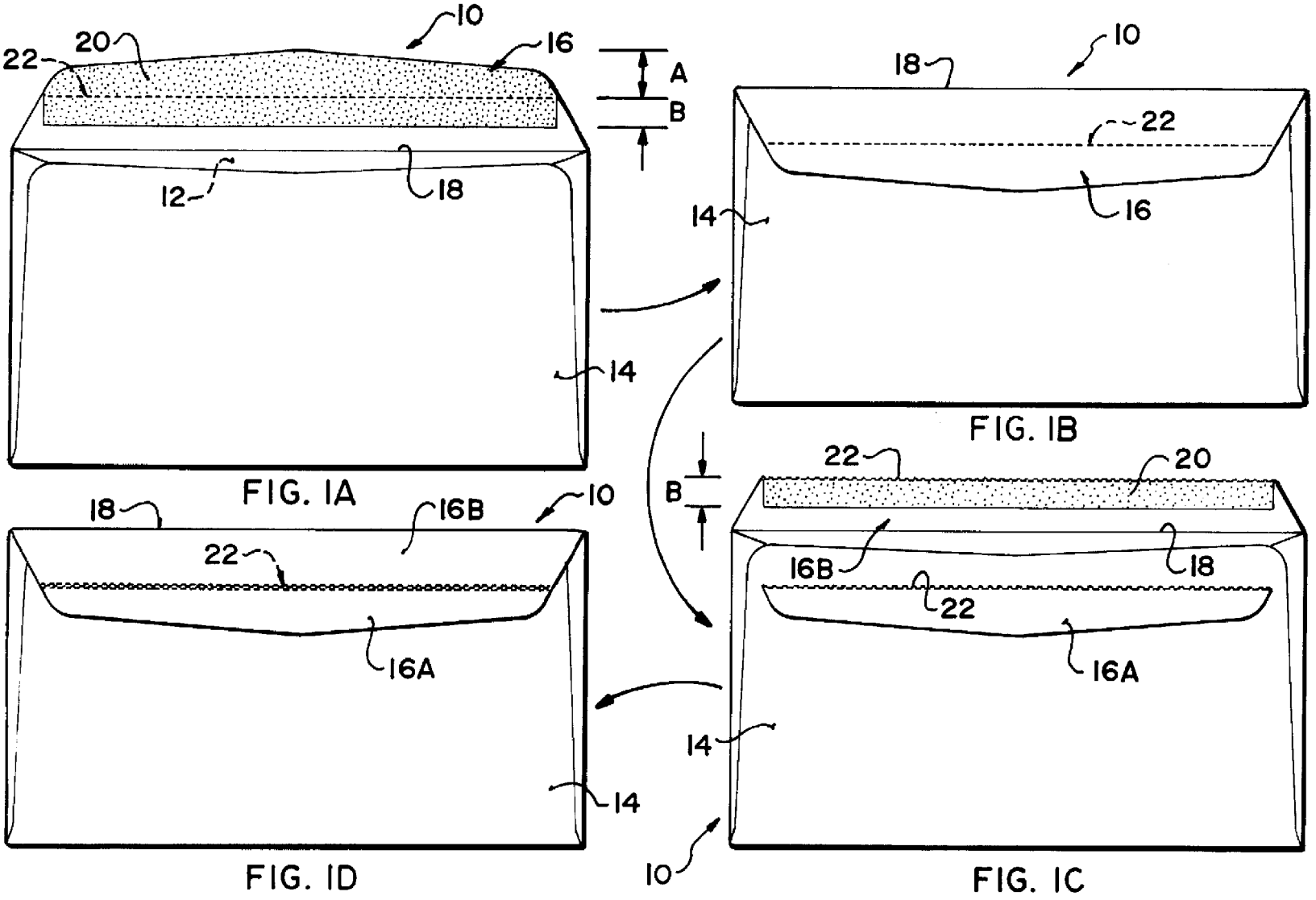
FIG. 1A illustrates a basic embodiment of the invention.
FIG. 1B shows the FIG. 1A envelope after it is closed for delivery to an addressee.
FIG. 1C shows the FIG. 1B envelope after it has been opened by the addressee.
FIG. 1D shows the FIG. 1C envelope after it has been resealed for reuse by the addressee.

FIG. 1A depicts a basic embodiment of the invention comprising envelope 10 having a front face 12 and a rear face 14. Front and rear faces 12, 14 are joined along their bottom and side edges to create a pocket defined by an opening which extends between the respective upper edges of front and rear faces 12, 14. A flap 16 is joined to front face 12 along fold 18 such that flap 16 may be folded to overlap a portion of rear face 14. An adhesive region 20 is provided on the inner face of flap 16, with line of weakness 22 extending through adhesive region 20.

Figure 3:
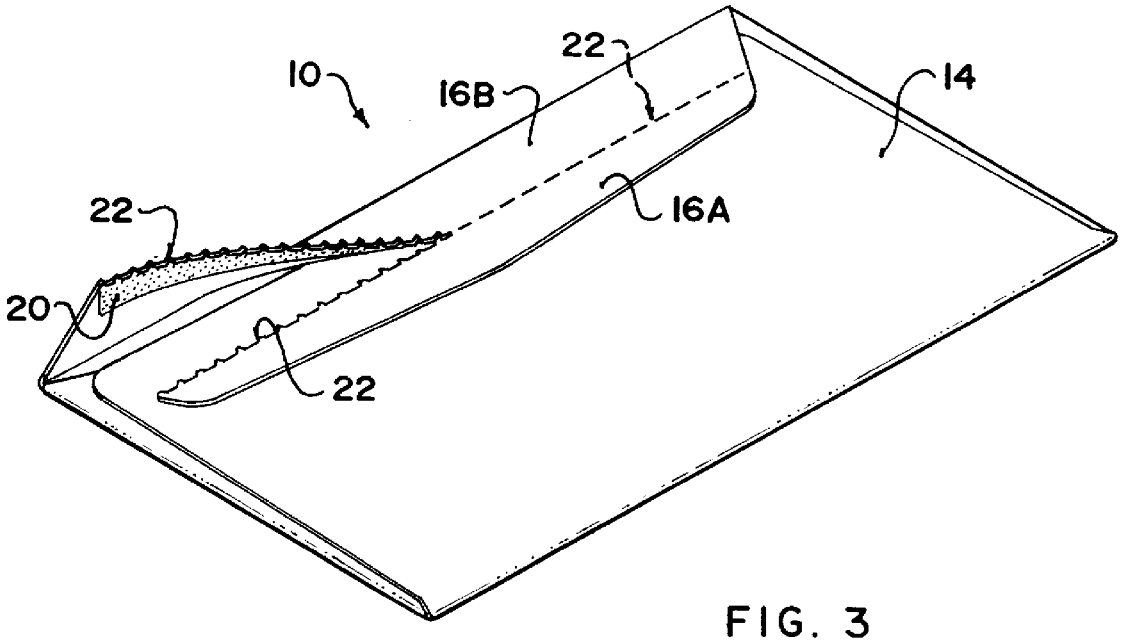
FIG. 3 is an oblique rear pictorial view of the FIG. 1B envelope in the process of being opened.

In operation, the original user of envelope 10 employs only that portion of adhesive region 20 lying above line of weakness 22 (as viewed in FIG. 1A) to attach flap 16 to rear face 14 in order to seal the envelope into the form shown in FIG. 1B for delivery to the addressee. As best seen in FIG. 3, the addressee opens envelope 10 by tearing along line of weakness 22. This leaves a first portion 16A of flap 16 adhered to rear face 14 while freeing an adhesive-bearing portion 16B of flap 16 as best seen in FIG. 1C. After removing the mailed material from envelope 10 the addressee may reuse the envelope by inserting mailing material thereinto and reseal the envelope by means of the adhesive remaining on flap portion 16B in order to attach flap portion 16B to rear face 14 to yield the resealed configuration seen in FIG. 1D.

Automatic mailing machinery is commonly employed to seal envelopes. Such machinery can be adjusted to control the application of an adhesive wetting agent (such as water) to a desired part of adhesive portion 20. However, it may in some cases be desirable to prevent possible migration of adhesive wetting agent across line of weakness 22 in order to prevent inadvertent affixation of both of flap portions 16A and 16B to rear face 14 when envelope 10 is first used. This can be achieved by providing a non-adhesive gap 24 (FIG. 7A) to overlie line of weakness 22 and separate adhesive region 20 into first and second adhesive zones 20A and 20B.

Figure 4A:
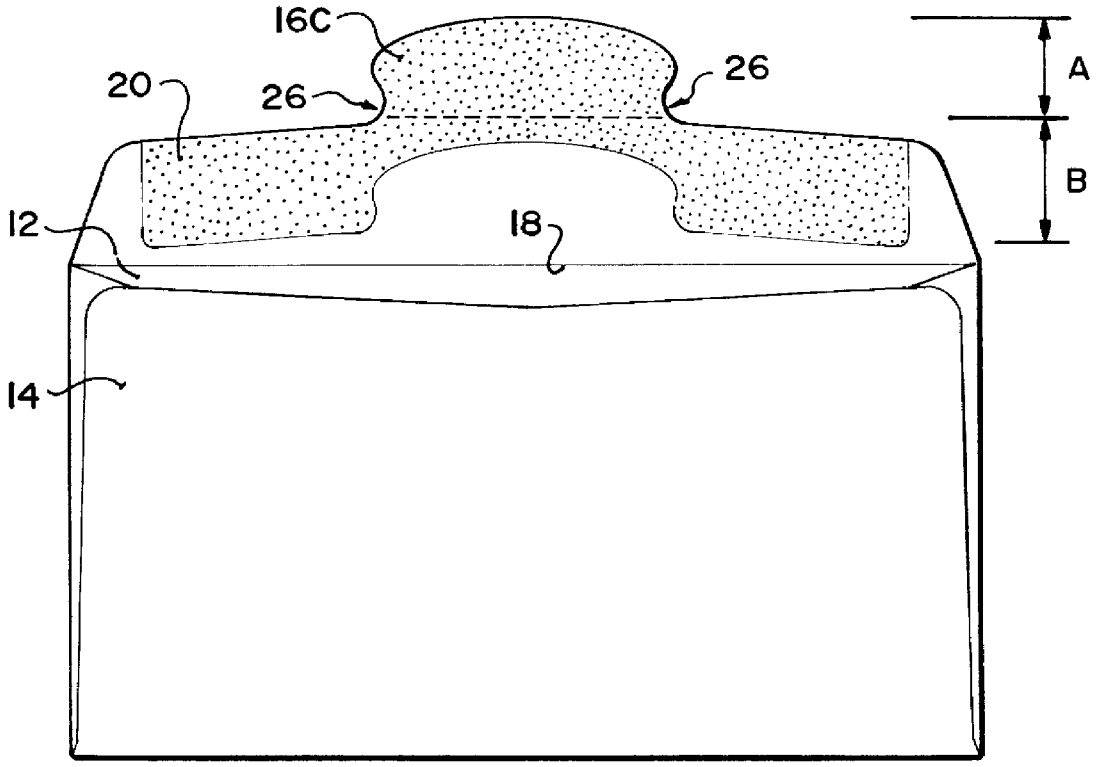
FIGS. 4A and 4B are rear elevation views of an alternative embodiment of the invention.
Figure 4B:
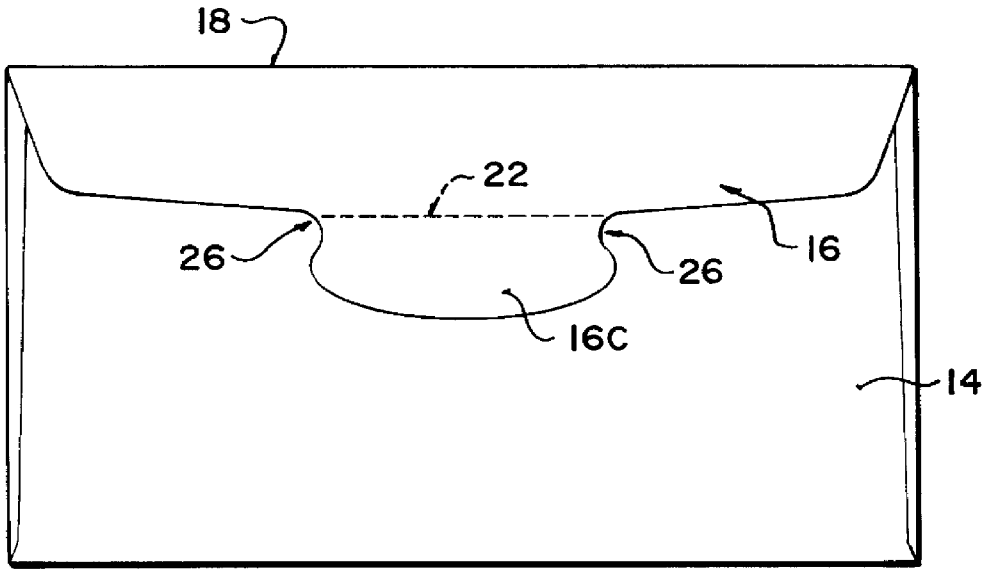

FIGS. 4A and 4B illustrate an embodiment of the invention in which flap 16 has a tab portion 16C of reduced width compared to flap 16 and envelope 10. This in turn reduces the length of line of weakness 22. Consequently, the addressee need only maintain the tearing operation over a reduced interval, thus reducing the possibility of uneven tearing which could damage flap 16 and prevent reuse of the envelope.

Figure 5A:
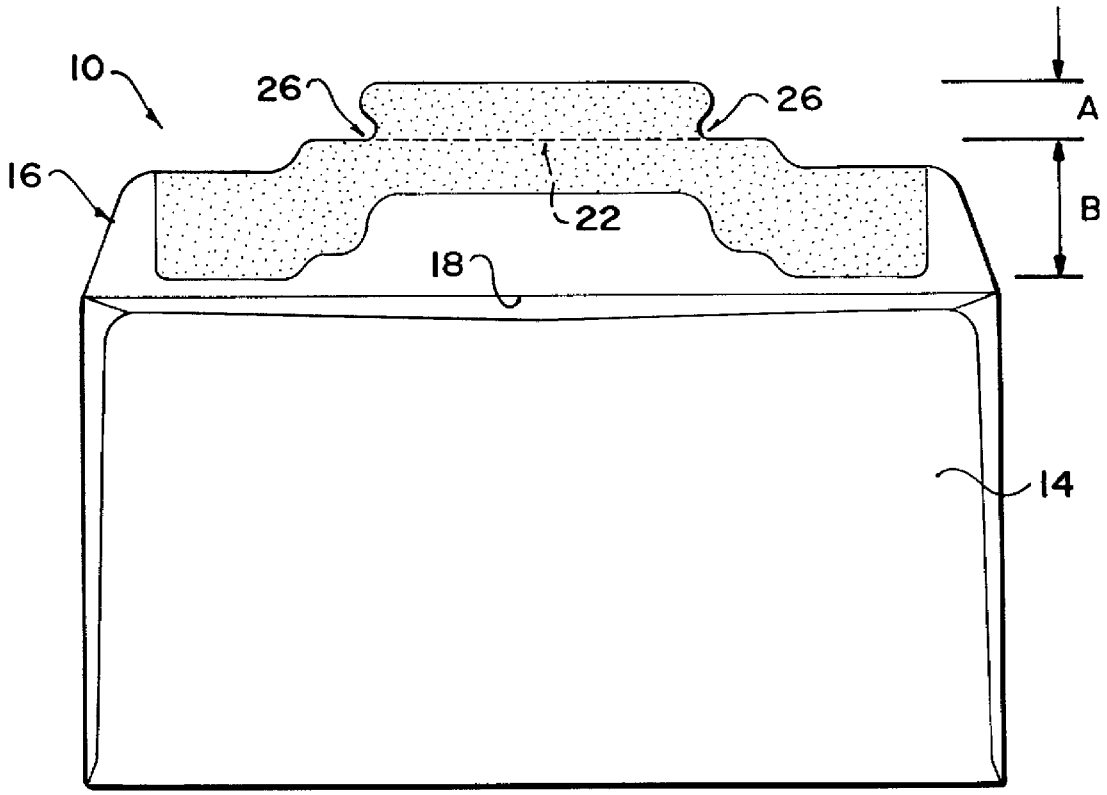
FIGS. 5A and 5B are rear elevation views of another alternative embodiment of the invention.
Figure 5B:
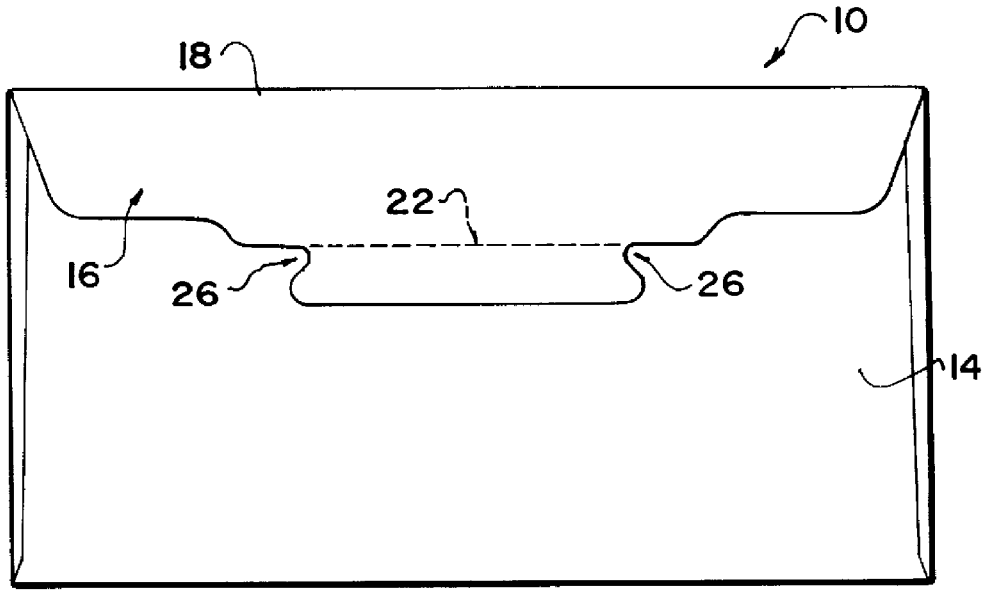

FIGS. 5A and 5B illustrate an embodiment somewhat similar to that of FIGS. 4A–4B, but employing a somewhat different configuration of flap 16.

Although most people should have little difficulty opening the envelope by tearing along line of weakness 22 it may in some cases be desirable to provide some assistance in "starting" the tearing operation. This can be achieved in various ways. For example, at least one notch 26 (FIGS. 4A–4B, 5A–5B) may be provided in the envelope closure flap at one end of the line of weakness. Notch 26 serves as an insertion point for a finger, letter opener, pen or other device and focuses the tearing operation on the line of weakness to minimize potential damage to the closure flap which might prevent reuse of envelope 10.

As another alternative, a tear strip 28 (FIG. 7A) can be embedded in flap 16 to extend along line of weakness 22. A free end 30 of tear strip 28 may be grasped by the user and pulled to tear cleanly along line of weakness 22, thus minimizing potential damage to flap 16 and preserving the envelope for reuse as aforesaid.

Figure 6A:
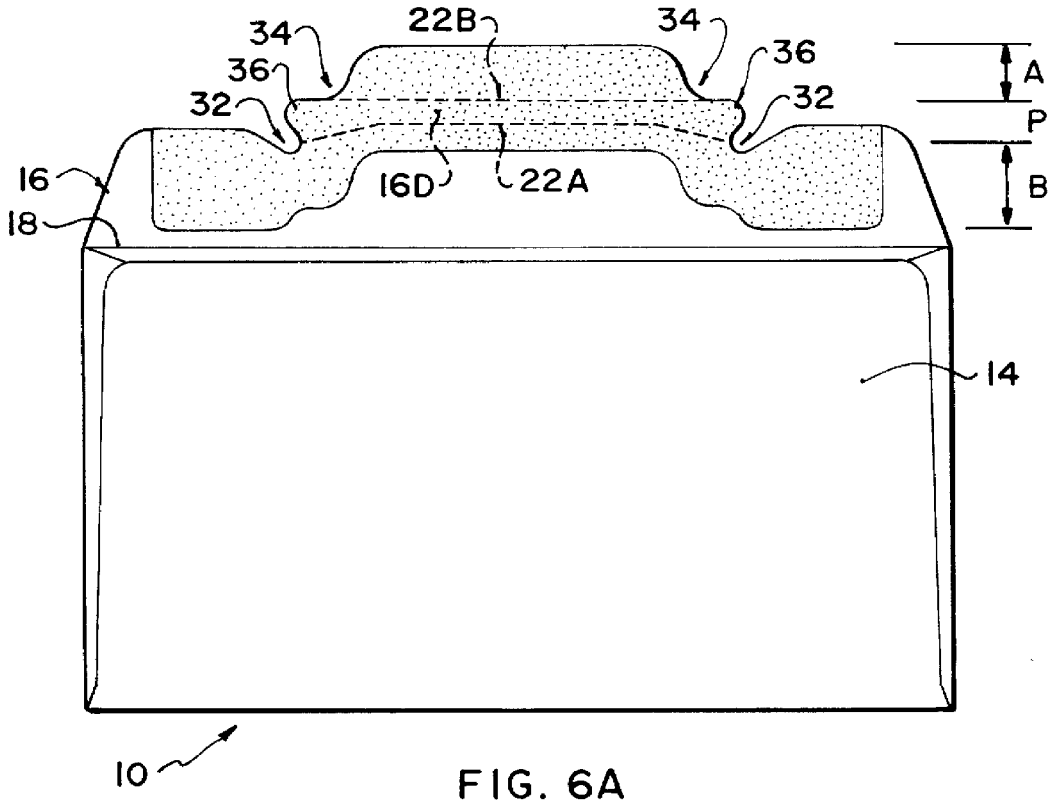
FIGS. 6A and 6B are respectively rear elevation and rear oblique pictorial illustrations of another alternative embodiment of the invention.
Figure 6B:
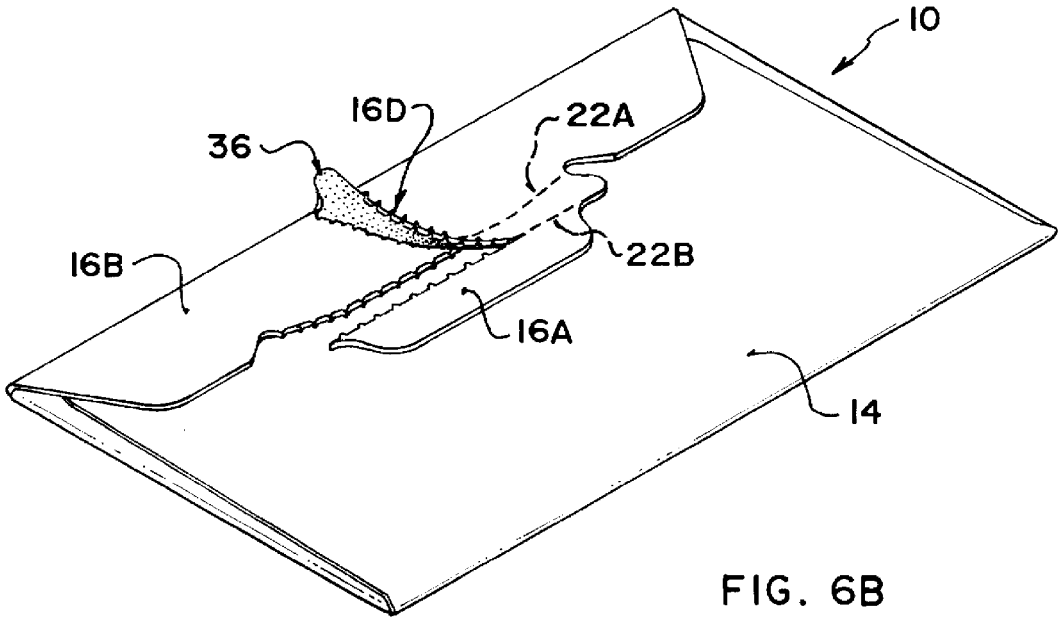

FIGS. 6A and 6B illustrate yet another alternative in which first and second lines of weakness 22A, 22B extend across adhesive region 20. Flap 16 may be configured as shown to define notches 32, 34 at the opposed ends of each of lines of weakness 22A, 22B and defining tab portions 36 therebetween. The addressee grasps either one of tab portions 36 and pulls to simultaneously tear along both of lines of weakness 22A, 22B. This operation removes a portion 16D which the addressee discards, while flap portions 16A and 16B (FIG. 6B) remain as aforesaid.

Figure 2:
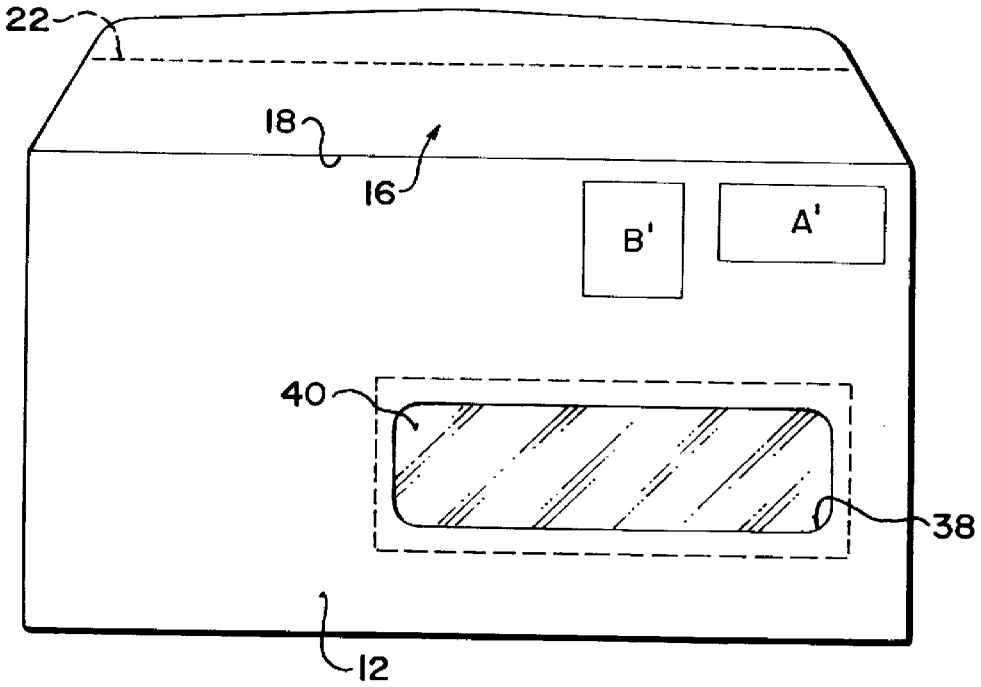
FIG. 2 is a front elevation view of the FIG. 1A envelope, additionally showing an address aperture covered by a transparent membrane and showing two areas for affixation of postage.

FIG. 2 depicts the front face 12 of envelope 10 and shows regions A' and B' which are respectively used by the original mailer and by the addressee to affix appropriate postage. FIG. 2 also shows the provision of an address aperture 38 in front face 12. A transparent, water-soluble membrane 40 such as poly-vinyl-alcohol material is fixed to an inner portion of front face 12 beneath aperture 38 to create a transparent "window" through which an address imprinted on mailing material inserted into envelope 10 is visible. The advantage of using a water-soluble material such as poly-vinyl-alcohol is that envelope 10 then becomes fully recyclable. Prior art "window" envelopes have employed other types of film materials which cannot conveniently be recycled, thus preventing recycling of such prior art envelopes.

Figure 7A:
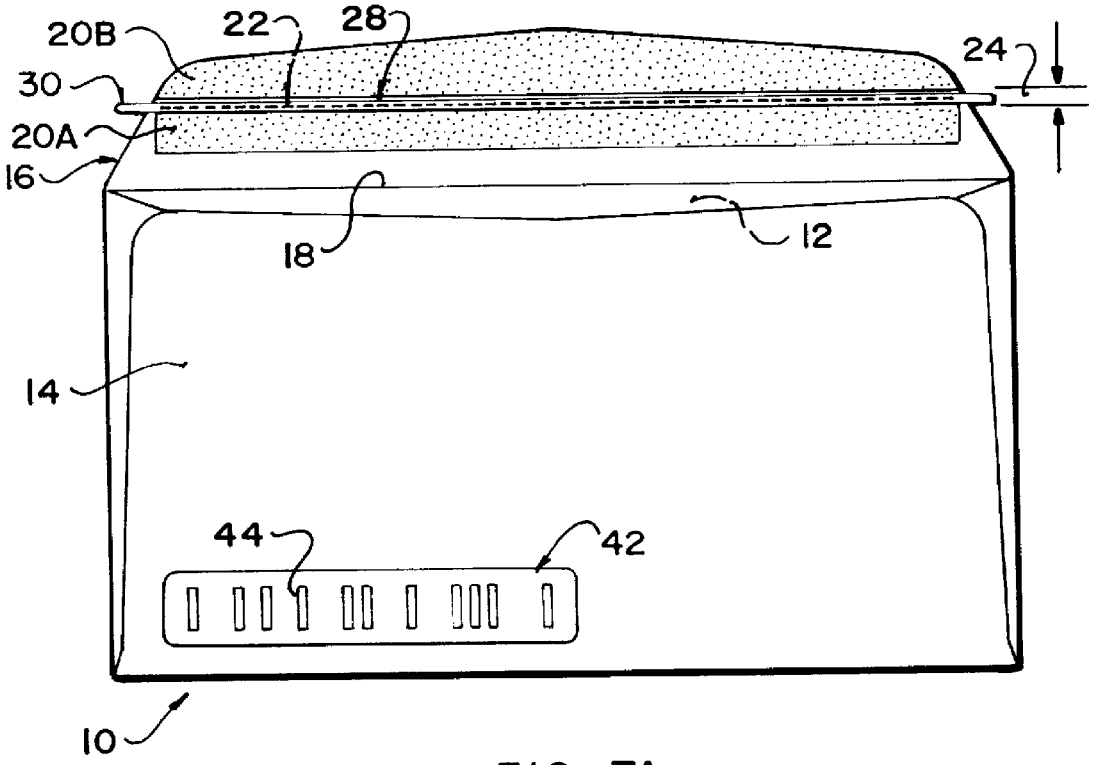
FIGS. 7A and 7B are rear elevation views of a further embodiment of the invention incorporating a tear strip and a removable label for receiving bar code information.
Figure 7B:
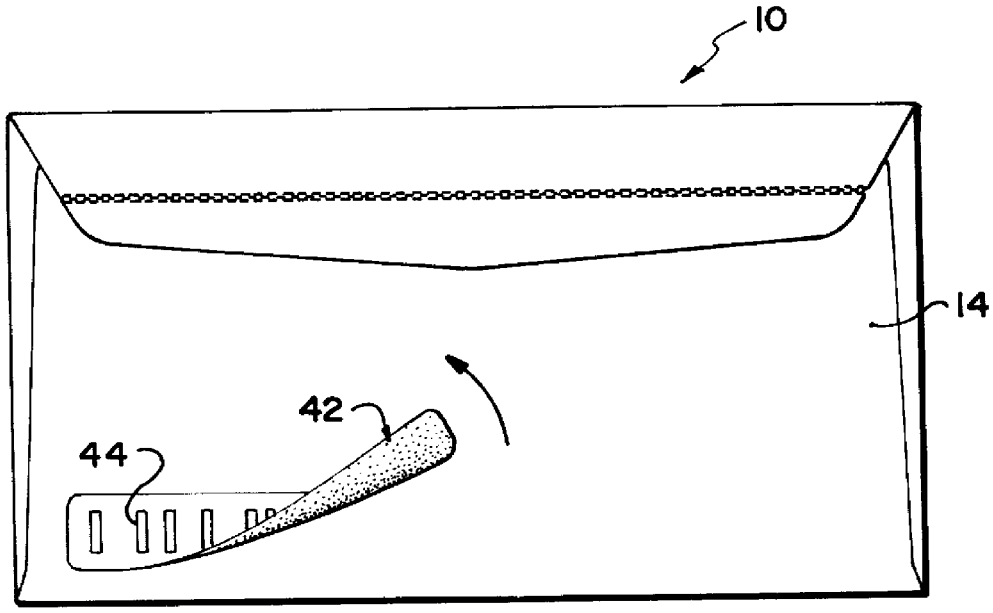

FIGS. 7A and 7B depict the affixation, to the envelope's rear face 14, of removable label 42. Label 42 is of a size and is located in a position on rear face 14 corresponding to that at which mail handling apparatus may apply postal bar code indicia 44. Conventionally, bar code indicia 44 is applied during the initial processing of envelope 10 before it is delivered to the addressee. Bar code indicia 44 is machine-readable and defines the addressee's address. To prevent disruption of the mail handling process, bar code indicia 44 is preferably removed from envelope 10 before it is reused by the addressee. This is accomplished by the addressee peeling label 42 off rear face 14 and discarding the label before reusing the envelope. In some cases label 42 may be applied to the envelope's front face 12; or, labels may be applied to both the front and rear faces, depending upon the bar coding methods adopted by the postal authorities in the particular jurisdiction.

Figure 8:
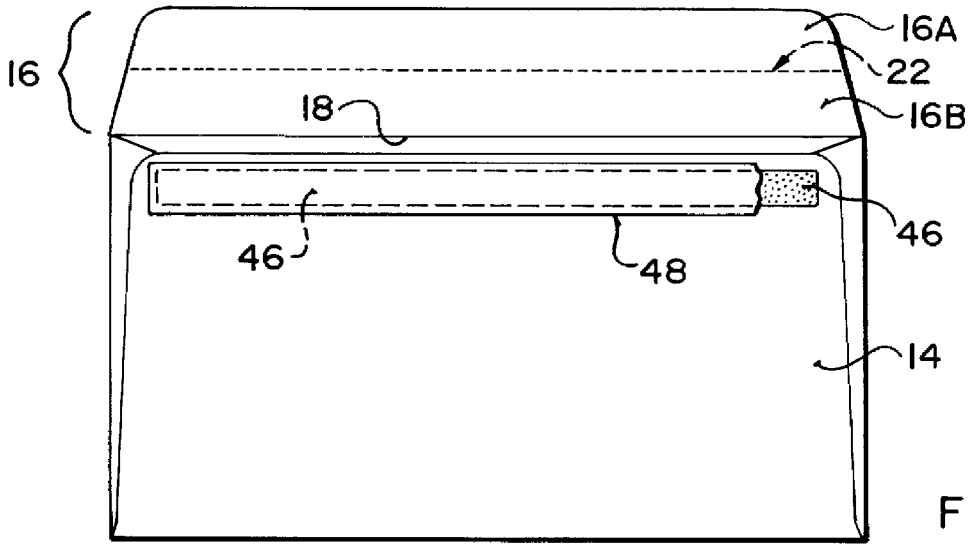
FIG. 8 is a rear elevation view of an embodiment of the invention without pre-applied adhesive.

In some cases it will be convenient to manufacture envelopes without pre-applying any adhesive thereto, as depicted in FIG. 8. Such envelopes may then be used with automatic mailing machinery having a built-in adhesive applicator. Such machinery could, for example, be configured to apply a dry, pressure-sensitive adhesive 46 covered by a removable strip 48 to the envelope's rear face 14; and, to also apply a wet adhesive to the upper portion 16A of flap 16. The machinery then folds flap 16 over onto rear face 14 such that the wet adhesive seals the envelope. The addressee opens the envelope by tearing along line of weakness 22, leaving flap portion 16A adhered to rear face 14, freeing flap portion 16B, and exposing cover strip 48. The cover strip is then peeled away to expose pressure-sensitive adhesive 46, which reseals the envelope when flap portion 16B is folded over against adhesive 46.

Figure 9:
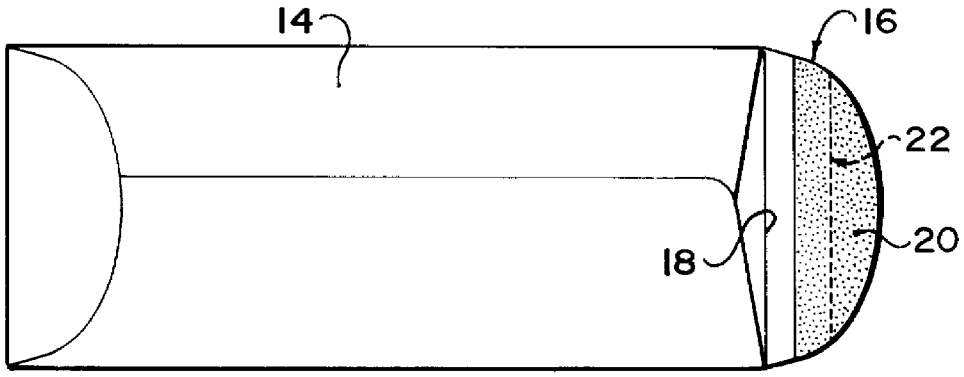
FIG. 9 is a rear elevation view of an embodiment of the invention having an end opening flap.

As depicted in FIG. 9, flap 16 need not be joined to front face 12 along one of its long sides, but may instead be joined along one of the shorter side edges to provide an end-opening envelope.

Figure 10:
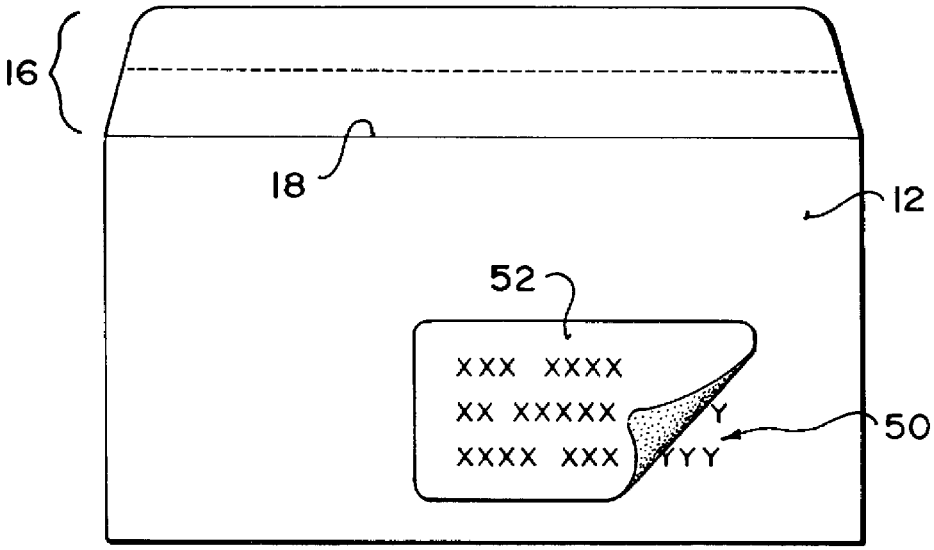
FIG. 10 is a front elevation view of an envelope showing a removable address label applied over a pre-printed return address.

As depicted in FIG. 10, parties using large quantities of envelopes may pre-print their return address 50 on the envelope's front face 12 and use automatic mailing machinery to apply a removable label 52 atop return address 50. The addressee's address is printed on label 52, either before or after label 52 is applied atop return address 50. The addressee removes and discards label 52 to expose return address 50, and then reuses the envelope to return material (such as a payment) to the original sender.

Figure 11:
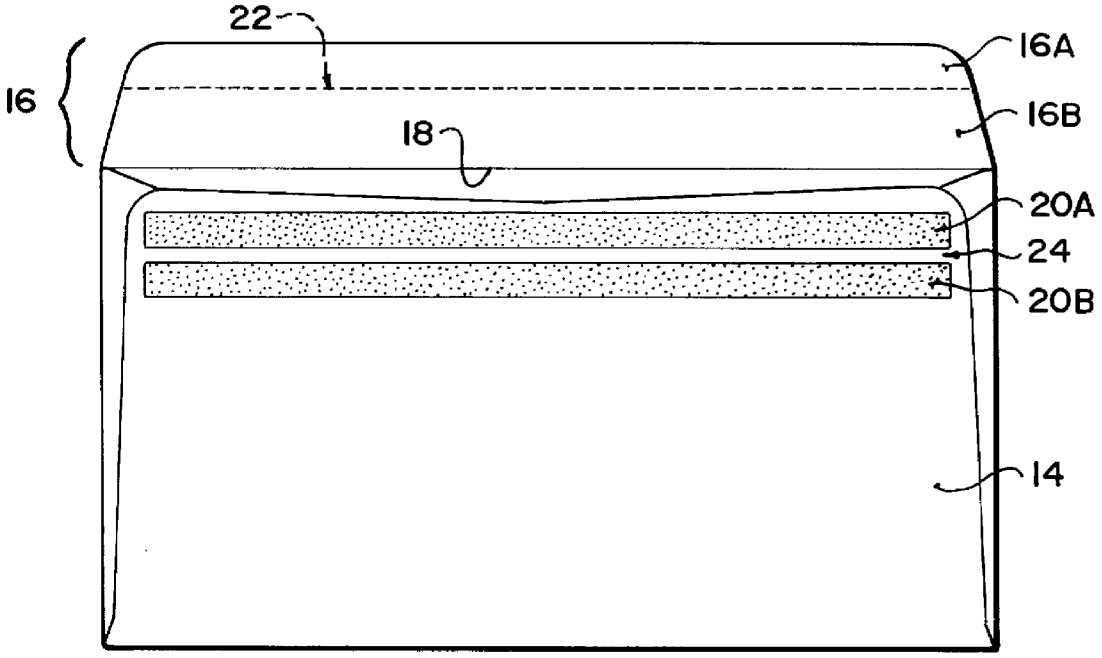
FIG. 11 is a rear elevation view of an embodiment of the invention having an adhesive region on its rear face.
Figure 12:
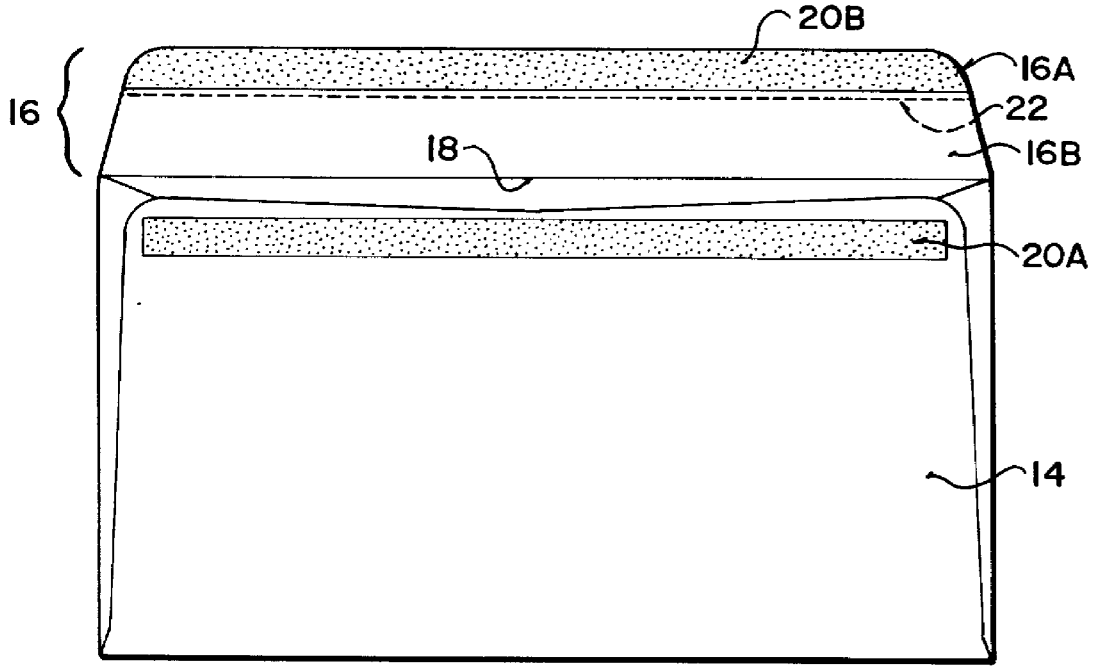
FIG. 12 is a rear elevation view of an embodiment of the invention having one adhesive region on its flap and another on its rear face.

If adhesive is pre-applied to the envelope, the adhesive need not be confined to flap 16, but may instead be confined to rear face 14, or may alternatively be partially on flap 16 and partially on rear face 14. For example, FIG. 11 shows adhesive regions 20A, 20B applied to rear face 14, with no adhesive applied to flap 16. The lower adhesive region 20B is initially used to seal flap 16 to rear face 14. The addressee opens the envelope by tearing along line of weakness 22, leaving flap portion 16A adhered to rear face 14 atop adhesive region 20B. This frees flap portion 16B and exposes upper adhesive region 20A which can then be used to seal flap portion 16B to rear face 14 for reuse of the envelope. If desired, a non-adhesive gap 24 may separate adhesive regions 20A, 20B to prevent migration of adhesive wetting agent from region 20B into region 20A in order to prevent inadvertent affixation of both of flap portions 16A, 16B to rear face 14 when the envelope is first used. FIG. 12 shows adhesive region 20B applied to flap portion 16A for initial closure or the envelope in its first use, and shows adhesive region 20A applied to rear face 14 for registry with flap portion 16B in reclosing the envelope for reuse. Given the foregoing description, different combinations of placement of the adhesive regions will be apparent to those skilled in the art.

Figure 13:
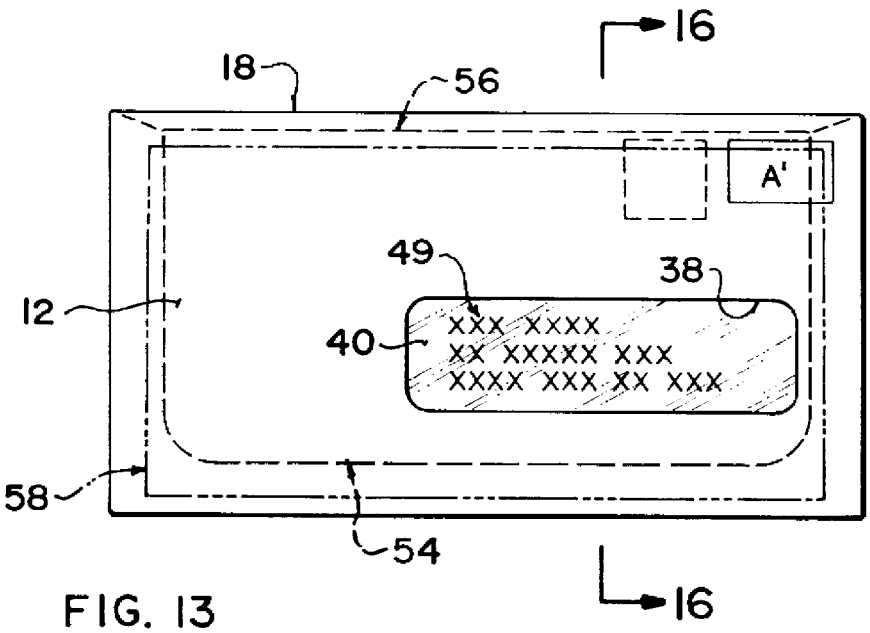
FIG. 13 is a front elevation view of an envelope having an integral, removable flap bearing a pre-printed return address inserted behind a first enclosure bearing an outgoing address.
Figure 14:
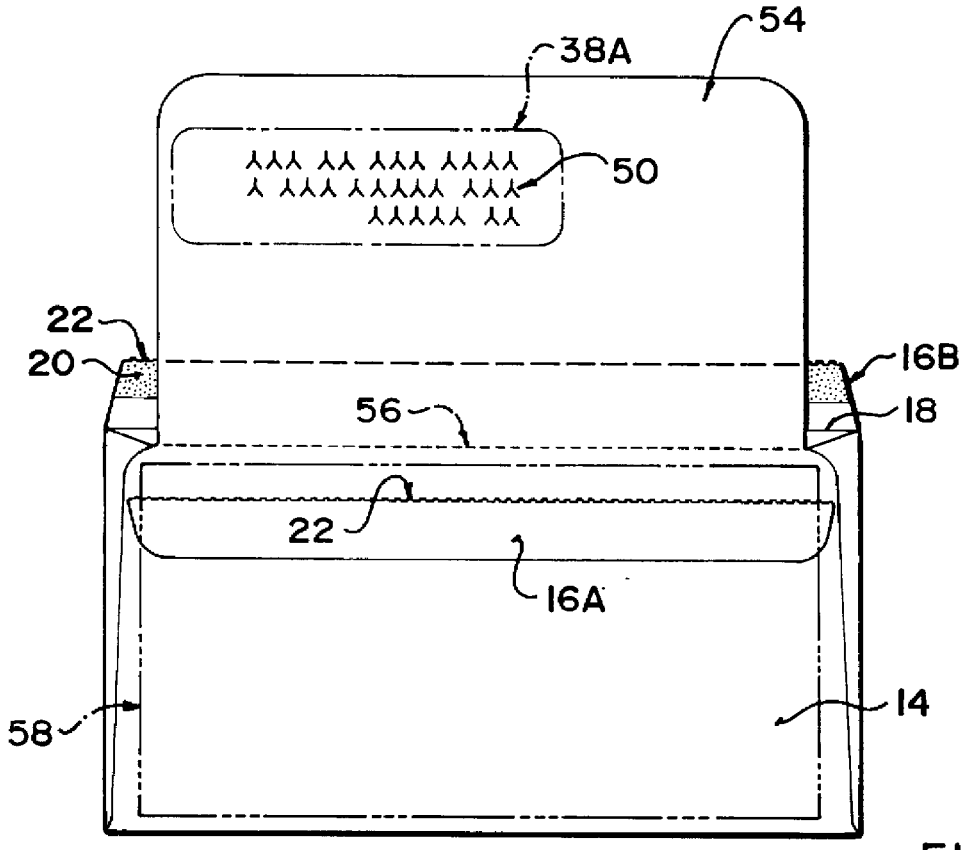
FIG. 14 is a rear elevation view of the FIG. 13 envelope, showing the flap extracted from the envelope.
Figure 15:
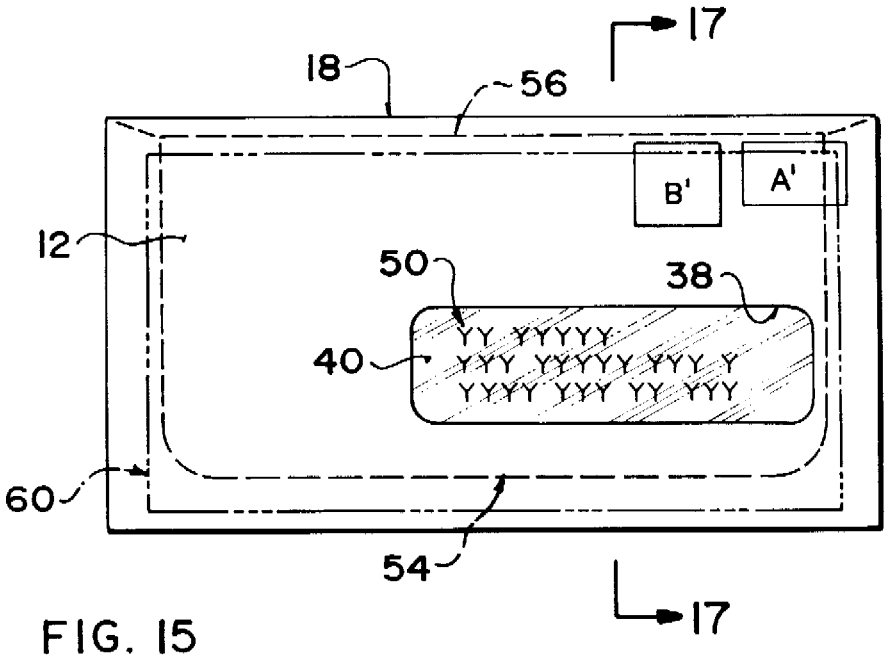
FIG. 15 is a front elevation view of the FIG. 13 envelope, showing the flap re-inserted into the envelope in front of a second enclosure.
Figure 16:
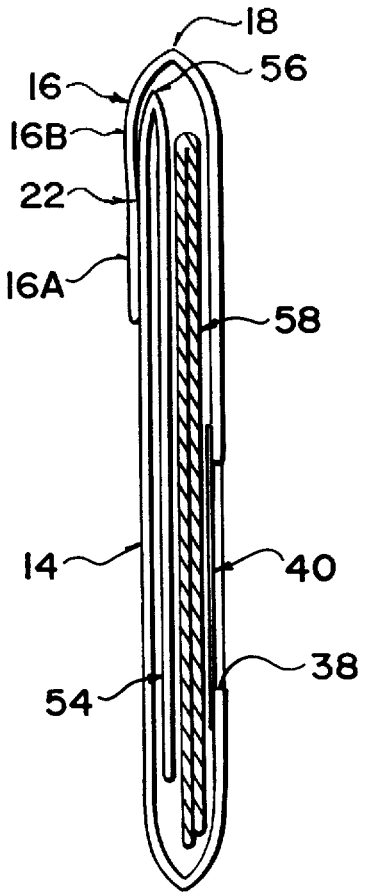
FIG. 16 is a cross-sectional side view taken with respect to line 16—16 of FIG. 13.
Figure 17:
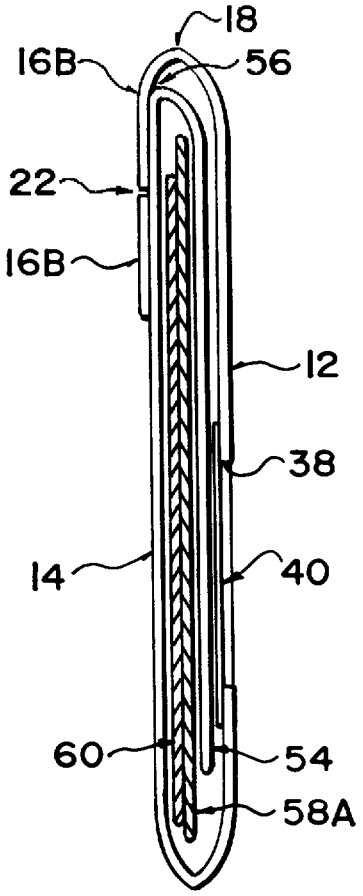
FIG. 17 is a cross-sectional side view taken with respect to line 17—17 of FIG. 15.

As depicted in FIG. 13, a second, removable flap 54 may be joined to the upper edge of rear face 14. Flap 54 is initially inserted into the envelope behind a first enclosure 58 such as a utility bill bearing an outgoing address 49 visible through window 38. The addressee opens the envelope by tearing along line of weakness 22 as previously described and withdraws enclosure 58. The addressee may also extract flap 54 from the envelope, as seen in FIG. 14. If desired, the addressee may remove flap 54 by tearing along optional line of weakness 56. Alternatively, the addressee may re-insert a portion 58A (FIG. 17) of first enclosure 58 (such as a payment stub) and a second enclosure 60 (such as a payment) into the envelope and then re-insert flap 54 so that it lies in front of portion 58A and second enclosure 60. This ensures that return address 50 pre-printed within the exposed window area 38A of flap 54 registers with window 38, with the return address 50 clearly visible through window 38.

As will be apparent to those skilled in the art in the light of the foregoing disclosure, many alterations and modifications are possible in the practice of this invention without departing from the spirit or scope thereof. For example, in any embodiment of the invention, flap 16 could be joined to the envelope's rear face, instead of being joined to its front face. In such case the envelope is closed by folding flap 16 over and sealing it to the front face. Postage, address information, etc. could be applied to flap 16, or to portions thereof, if desired. Accordingly, the scope of the invention is to be construed in accordance with the substance defined by the following claims.

What is claimed is:

1. An envelope, comprising:

(a) a front face;

(b) a rear face joined to said front face to form a pocket having an opening between adjacent edges of said front and rear faces;

(c) a first flap joined to said front face edge and foldable to overlap a portion of said rear face;

(d) a first adhesive region on said first flap positioned to overlie a first part of said rear face portion when said first flap is folded to overlap said portion;

(e) a second adhesive region on a second part of said rear face portion;

(f) a line of weakness extending across said first flap, said line of weakness positioned between and separating said first and second parts of said rear face portion when said first flap is folded to overlap said portion;

(g) an address aperture in said front face; and, (h) a second flap having a pre-printed return address and joined to said rear face edge and foldable from a first position outside of said pocket to a second position disposed within said pocket wherein, in said second position, said return address is aligned with said address aperture so that said return address on said second flap is visible through said address aperture.

2. An envelope as defined in claim 1, further comprising a removable label adhered to said envelope at a location remote from said address aperture and said pre-printed return address visible from the outside of said envelope in an area where mail handling apparatus applies postal bar code indicia to said label, thereby facilitating removal of said label bearing said postal bar code indicia from said envelope by a first recipient of said envelope.

* * * * *